US005467833A

United States Patent [19]

Crain

[11] Patent Number: 5,467,833

[45] Date of Patent: Nov. 21, 1995

[54] SYSTEM FOR LIFTING TUBULARS AND EQUIPMENT BELOW THE MAIN DECK OF PLATFORMS

[76] Inventor: Jack A. Crain, 107 Fabiola Ave., Lafayette, La. 70508

[21] Appl. No.: 255,652

[22] Filed: Jun. 8, 1994

[51] Int. Cl.[6] ..... E21B 19/00

[52] U.S. Cl. ..... 175/52; 175/162; 175/203; 166/338

[58] Field of Search ..... 175/5, 7, 203, 175/52, 162; 166/338, 340; 254/274, 286, 314

[56] References Cited

U.S. PATENT DOCUMENTS

| | | | |
|---|---|---|---|
| 2,984,455 | 5/1961 | Fischer | 254/274 |
| 3,368,619 | 2/1968 | Postlewaite | 175/7 |
| 3,456,745 | 7/1969 | Peri | 175/5 |
| 3,517,737 | 6/1970 | Petersen | 175/7 |
| 3,891,038 | 6/1975 | Delestrade et al. | 254/274 |
| 4,125,164 | 11/1978 | Terry | 166/377 |
| 4,305,467 | 12/1981 | Villines . | |

OTHER PUBLICATIONS

Zip Tool Co. Inc. sales brochure on Zip Tool Co. power lift.

*Primary Examiner*—Michael Powell Buiz
*Assistant Examiner*—Frank S. Tsay
*Attorney, Agent, or Firm*—Pravel, Hewitt, Kimball & Krieger

[57] ABSTRACT

Apparatus is provided for lifting equipment or tubulars below the deck of a platform or a drilling rig. Lifting force is monitored with a load cell. A portable platform is added above the deck of an offshore platform to allow running or retrieving a string of tubulars through the deck, thereby avoiding the need to deploy a workover or drilling rig to the platform.

11 Claims, 2 Drawing Sheets

SYSTEM FOR LIFTING TUBULARS AND EQUIPMENT BELOW THE MAIN DECK OF PLATFORMS

SPECIFICATION

1. Field of the Invention

This invention relates to aboveground apparatus and method for use around wells. Specifically, apparatus and method are provided for lifting a string of tubulars and other equipment which is located below the main deck of a platform located above a well.

2. Background of the Invention

In offshore oil and gas operations, fixed platforms supported by piles driven into the sea floor are commonly used to support drilling and production equipment. These platforms usually consist of two or more decks: a main deck at the top and at least one deck lower and closer to the water. It is common for the platform to be constructed after at least some of the wells are drilled and completed.

After a platform is constructed, there are a variety of operations requiring lifting of equipment or tubulars. The commonly used method for lifting tubulars is a drilling or workover rig which is moved to the platform. However, in many instances the mobilization of such rig to the platform and its use for the time required to carry out the process of lifting is very expensive.

The need to provide lifting and moving capability for tubulars arises, for example, when it is desired to "tie-back" casing and other tubulars from the sea floor to the main deck of the platform. Another instance is for the recovery of casing from wells to be plugged and abandoned. In instances where a standard blowout preventer is not used, the drilling rig's lifting equipment may not be suitable for larger-than-normal blowout preventer sizes and special winches are often utilized. Other equipment which may require lifting force from a platform includes wellhead trees, which may require repair or replacement during the life of wells producing from the platform.

U.S. Pat. No. 4,305,467 provides apparatus for lifting a blowout preventer during oil and gas drilling operations. The apparatus includes a pair of winches attached to a base frame which can be transported to a drilling rig. The two winches are then used to lift a blowout preventer which is below the main deck of a platform or below the floor of a land drilling rig. For such applications when BOPs larger than the rig BOPs are to be lifted, the equipment normally present on the drilling rig is not suitable.

There is a need for equipment which is less expensive to deploy than drilling or workover rigs and which can be used to lift tubulars or other equipment which exists below the main deck of a platform. Preferably, such equipment should comprise means for measuring the force exerted by the equipment. Apparatus and methods for using such equipment to remove tubulars from wells or place tubulars below the platform of offshore wells are also needed. There is also a need for apparatus to lift any equipment below the deck of a platform or drilling rig and monitor the lifting force on such equipment as the lifting apparatus is being employed.

SUMMARY OF THE INVENTION

A winch apparatus is provided for lifting a load located below the deck of a platform and measuring the force of lifting. A winch is attached to a pivoted beam which is supported by a load cell above a base. The winch apparatus is employed for lifting apparatus below the deck or for moving strings of tubulars through an aperture in the deck of a platform. For moving tubulars, a movable deck supported by movable beams is placed above the platform deck to support slips which support tubular strings and an elevator is moved below the main deck of the platform by the winch to lift or lower the string of tubulars into and out of a well or water below the platform.

DETAILED DESCRIPTION OF THE INVENTION

Figure 1:
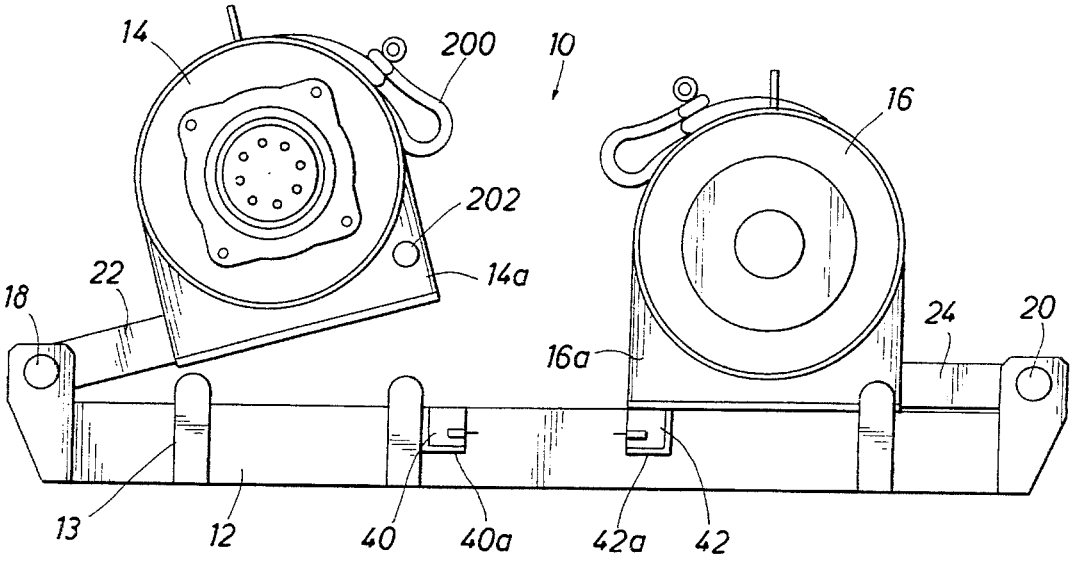
FIG. 1 shows a side view of two winches pivoted on beams with load cells in position to measure lifting force.

Referring to FIG. 1, winch unit 10 is supported by base frame 12 having lateral supports 13. Winches 14 and 16 are affixed to winch beams 22 and 24, respectively, and winch beams 22 and 24 are fixed in a pivotal relationship to base frame 12 by pivots 18 and 20, respectively. Pivots 18 and 20 are preferably a shaft having a bearing thereon, either permanently or removably attached to base frame 12. Winch unit 10 also includes means for measuring the force exerted by each winch when being operated. Such means may be provided by load cells 40 and 42. An electronic load cell such as Revere Transducer Model CSP1-B6-100k-30P5 may be used. This instrument has a rated working capacity of 100,000 lb. Other electronic or mechanical load cells may be used. Preferably, such load cell is supported by cell supports 40*a* and 42*a*, such supports being welded or otherwise attached to base 12 so as to form a short gap between beam 22 or 24 and base 12. Cell supports 40*a* and 42*a* preferably are mounted such that winch beams 22 and 24 of winches 14 and 16 are approximately parallel to base frame 12 when a load cell is contacted by a beam. This means of supporting the winch on a load cell provides a fail-safe means for supporting, since a failure of the support or load cell would not allow significant movement of the winch. In contrast, failure of a strain gage mounted in the load line could cause great damage to equipment or personnel. Total displacement of the load cell from zero to maximum load is only a small fraction of an inch; however, pivots 18 and 20 must be located so as to provide sufficient gap between winch beams 22 and 24 and base 12 to allow maximum load to be placed on a load cell while maintaining a gap between winch beams and the base frame.

Figure 2:
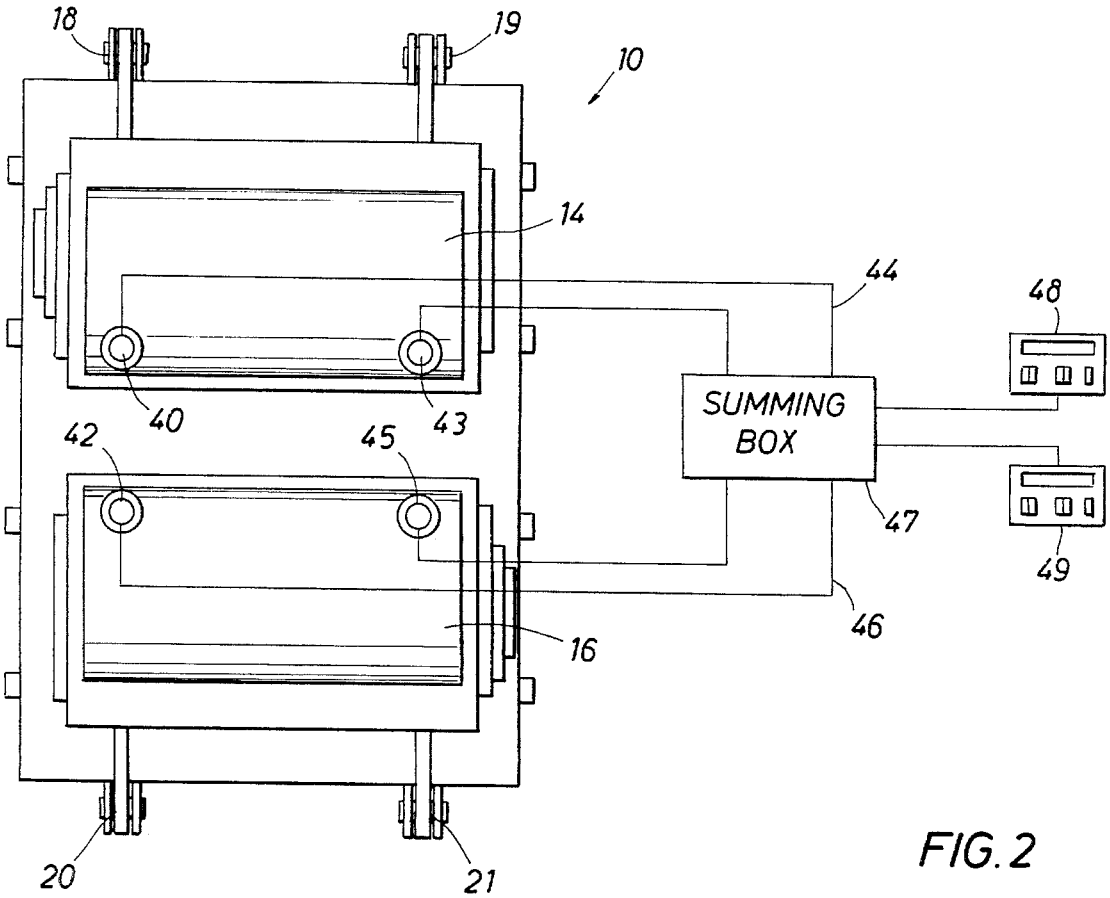
FIG. 2 shows a top view of two winches with load cells in position to measure lifting force and the electronic equipment for reading lifting force.

Referring to FIG. 2, load cells 40 and 43 measure total load supported by winch 14 while load cells 42 and 45 measure total load force exerted by winch 16. Alternatively, a single load cell could be mounted on a cross-beam (not shown) which could support the winch by the load cell such that a gap exists between winch beams 22 and 24 and base 12. With two load cells for each winch, as shown in FIG. 2, electrical leads 44 and 46 enter summing box 47, which sums the output of load cells and provides a signal to readouts 48 and 49 of the total force exerted by each winch. Readouts 48 and 49 may be a digital output weight indicating system such as that manufactured by Rice Lake Weighing Systems, Inc. Such system may provide basic tare and zero functions, digital memory for comparing loads, RS232 port for computer interface and other functions.

Apparatus shown in FIGS. 1 and 2 allows constant monitoring of the force exerted by the winches as they are being utilized. Such constant monitoring is very valuable when the load required to move an object below the main deck of a platform is unknown. For example, after cementing of a well having a blowout preventer in place on the casing of a well, cement may unexpectedly enter the blowout preventer, because of unexpected flow conditions during pumping of the cement. After sufficient time for this cement to develop strength, if a winch unit such as shown in FIG. 2 but without the load cell were employed in an attempt to lift the blowout preventer off the casing, a greater force may be required than the winch is designed to produce. This condition could lead to failure of the cable on the winch or some other equipment. Therefore, the load cells serve as an important safety feature of such lifting equipment. Placement of readout units 48 and 49 of FIG. 2 near the controls of the winch allows an operator to operate the equipment while constantly monitoring the force exerted by the winch and preventing such force from exceeding a selected safe upper limit. Automatic warning devices may also be employed to sound an alarm if the maximum safe limit on force exerted by a winch is exceeded.

Load cells are calibrated using known techniques. For more precise measurements of lifting force, correction may be made for the difference in distance of the load cell and the cable from the pivot point of a winch. The moment arm of the load cell, exerting an upward force, and the moment arm of the rope over the drum of a winch, exerting a downward force, will usually not be precisely the same. Such difference in moment arms, or distances from pivot point 20 or 22, can be accounted for with the apparatus of this invention by multiplying the ratio of moment arms to the reading of the load cell to calculate the true force applied by the winch.

Figure 3:
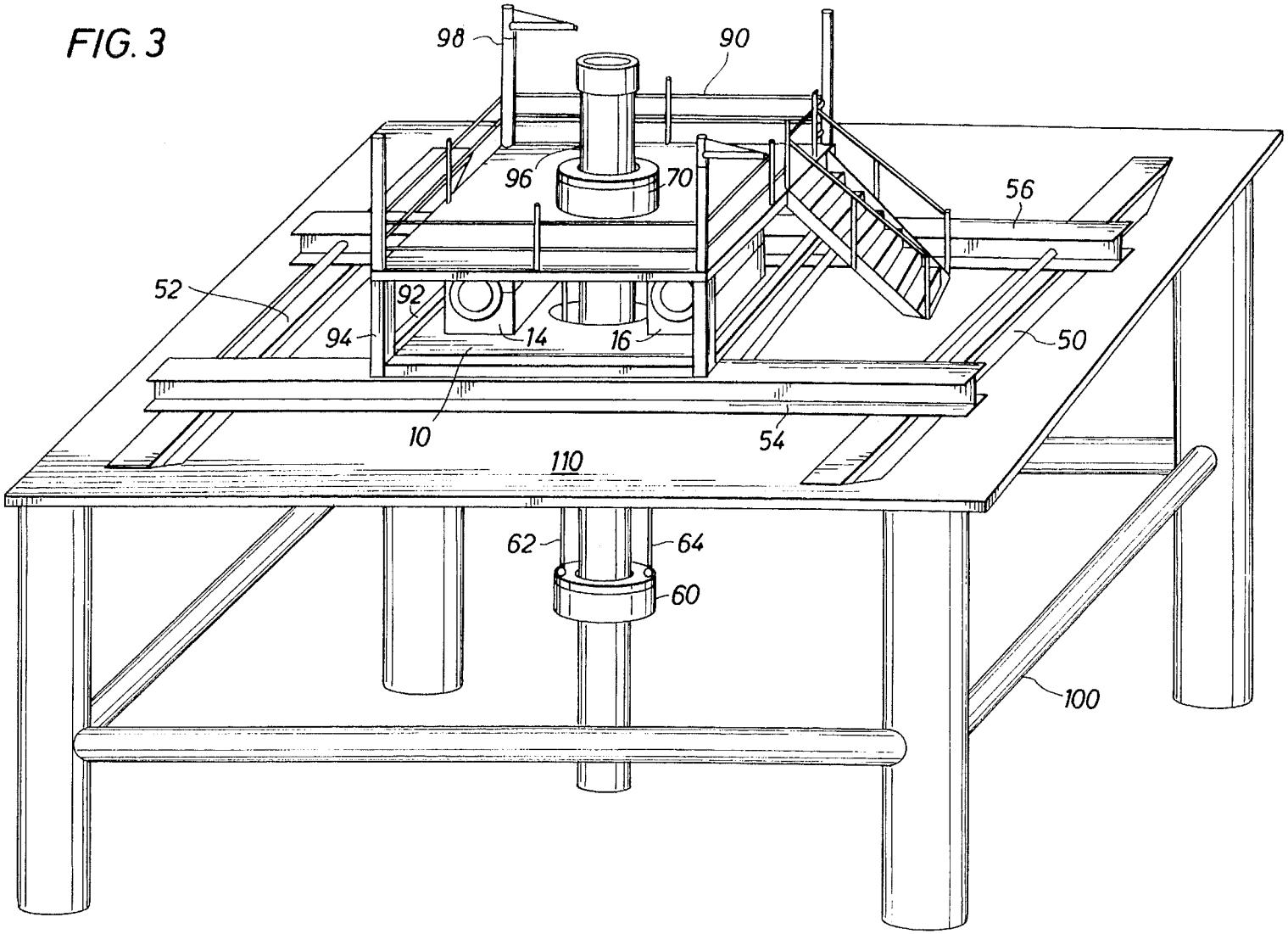
FIG. 3 shows a perspective view of equipment mounted on a platform for placing or removing tubulars through the platform.

Referring to FIG. 3, offshore platform 100 has main deck 110. Beams 50 and 52 are skid beams normally provided as part of a platform. Movable beams 54 and 56 have been provided as a part of the equipment for lifting tubulars from below main deck 110. Platform 100 usually includes at least one lower deck (not shown), and may include several lower decks. Movable platform 90 has been placed upon movable beams 54 and 56 and located such that an aperture (not shown) through movable deck 96 can be placed directly above an aperture through deck 110. Cross-beams may connect movable beams 54 and 56. Tens of apertures may exist through deck 110 on some platforms, each aperture being used for allowing movement of tubulars into a separate well through separate "slots" on the platform. Movable platform 90 can be moved on skid beams 50 and 52 and movable beams 54 and 56 so as to place the aperture of movable deck 90 directly above the slot for a well of interest. Movable platform 90 has support beams 92 and 94 designed to withstand the maximum lifting load to be used in the operation to be performed. Posts 98, attached to movable deck 90, are designed to serve as a fixed point for power tongs which may be used to make up or disengage threaded connections on tubulars to be supported through main deck 110. Posts 98 may also serve to anchor movable platform 90 to fixed platform 100. Wire rope (not shown) may be used to extend from movable platform 90 to fixed platform 100 to avoid rotation of movable platform 90 when forces are exerted on the platform from operations thereon. Other means may be used for fixing movable platform 90 to fixed platform 100.

The lifting force for tubulars is supplied by winch unit 10, comprising winches 14 and 16. Winch unit 10 may include a base and load cells (not shown) such as shown in FIGS. 1 and 2, or winches 14 and 16 may be attached to movable platform 90 through a pivoted beam such as beams 22 and 24 and supported by a load cell supported by movable platform 90. Cables 62 and 64 from winches 14 and 16, respectively, may be attached to elevator 60. Elevator 60 is of a design well-known in the industry for lifting tubulars. Preferably, elevator 60 is a remotely controlled elevator, which may be controlled by an operator from the main deck. Elevator 60 may be a Varco casing elevator/spider having pneumatic controls, the controls being activated through a hose extending from the main deck. Alternatively, elevator 60 may also be manually controlled and accessed from below main deck 110. Cables 62 and 64 may be attached to elevator 60 by appropriate techniques well-known in industry.

If casing is to be run through the main deck in order to tie-back casing from the sea floor to the elevation of the main deck, the following procedure may be followed. The bottom joint of tie-back casing, having connector attached thereto, is picked up by the deck crane on the platform (not shown) and lowered through the aperture of movable deck 96 and main deck 110 and set in slips 70. Elevator 60 is raised by winch unit 10 to a position near and below main deck 110. A second joint of casing is then raised by the platform crane into position and threaded onto the first joint using power tongs (not shown) attached to post 98. Casing is set in elevator 60 and using winch unit 10 and elevator 60, the two joints of casing are raised to release slips 70 and then lowered through the apertures of the decks. The casing is lowered to the point where the second joint of casing may be joined to the third joint. Slips 70 are then set and the process of threading the next joint of casing is repeated. With the casing set in slips 70, elevator 60 is released and retrieved to a position slightly below main deck 110, where elevators 60 are then activated to support the casing and the process of lowering the string of tubulars is repeated. This process continues until the casing string has been extended far enough to tie onto the top of the subsea wellhead near the sea bed.

If the apparatus of FIG. 3 is to be used for plugging and abandonment of a well, wherein the casing string may extend from the sea floor to a fixed platform deck 110, the casing or other tubular is cut at the depth at which it is to be retrieved, normally a few feet below the seafloor, while elevator 60 is at its lowest travel point on the casing. This may be at the level of the production deck of the platform or the next lowest deck below the main deck. Winch unit 10 is then used to raise the casing until elevator 60 is near and below main deck 110, monitoring the load during the entire raising operation to insure that the force exerted by the winch is within safe limits. With elevator 60 at its upper position of travel, the casing is set in slips 70. If the upward movement distance is less than the length of one joint of casing, elevators 60 are released and lowered to the vicinity of the production platform, where the elevators are again attached and winch unit 10 is used to raise the casing to the point that threads at the lower end of the top-most joint may be disengaged, normally by use of power tongs (not shown) attached to posts 98. This process is repeated until the string of tubulars is removed through main deck 110.

Drill pipe may also be moved into and out of equipment at the sea floor by means of winch unit 10. The same procedures are used as described above. The drill pipe may further be turned while at its lowest elevation by a spinning wrench or other means on movable deck 90. By this means, the equipment of this invention can be used to drill for special applications, such as removing cement from a short section inside a tubular or cleaning a wellhead before it is to be removed.

Apparatus of this invention may be used to remove equipment below a deck of a platform or a land drilling rig without movable platform 96. In such uses, winch unit 10 of FIG. 1 may be used to lower cable (not shown) having clevis 200 attached thereto. A rigging comprising clevis 200 may be used to support the equipment to be lifted, such as a blowout preventer. If there is a need to lift with a force greater than the capacity of the wire rope, a doubling of the force may be obtained by attaching a sheave to the equipment to be lifted, passing the wire rope over the sheave and attaching clevis 200 at winches 14 and 16. Cylindrical beam 202, supported in housing **14*a* or 16*a* of winches 14 and 16, provides a convenient anchor at the winch for a wire rope with clevis 200 attached. Although only two winches are shown in the figures, additional winches can be employed by extending base frame 12 to support additional winches. For example, two additional winches can be placed on a base frame extending in a perpendicular direction to base frame 12**. Each winch is preferably supplied with a means for monitoring force exerted by the winch. Alternatively, only one winch may be used for some applications.

It will be appreciated that while the present invention has been primarily described with regard to the foregoing embodiments, it should be understood that variations or modifications may be made in the embodiments described herein without departing from the broad inventive concept disclosed above or claimed hereafter.

What I claim is:

1. Apparatus for lifting and measuring the lift force of a load located beneath a platform or rig deck, the deck having an aperture therethrough, comprising:

a base frame, the base frame having an aperture therethrough;

a winch, the winch disposed on a winch beam at a selected position on the beam, the beam being supported at a spaced apart distance above the base frame by a pivot disposed at a selected position on the beam and;

a load cell, the load cell being supported by the base frame at a selected distance from the pivot and disposed so as to support the winch beam at a spaced apart distance above the base frame.

2. The apparatus of claim 1, wherein the load cell is electrically operated.

3. The apparatus of claim 1, wherein the pivot comprises a bearing and shaft.

4. Apparatus for moving a string of tubulars through an aperture in a deck over a well comprising:

a least two movable beams adapted to extend between skid beams on a platform;

a movable platform adapted to be supported by the movable beams at a selected distance above the deck and to receive slips for supporting the string of tubulars;

winch apparatus, the winch apparatus comprising a base frame with an aperture therethrough and a winch disposed on a pivoted beam, the winch apparatus being adapted to be located between the movable platform and the deck; and a cable wrapped on the winch and supporting an elevator adapted to support the string of tubulars.

5. The apparatus of claim 4 wherein the elevator is remotely controlled.

6. The apparatus of claim 4 wherein the winch is supported by load cells so as to measure the lifting force of the winch apparatus.

7. A method for moving a string of tubulars through an aperture in the main deck of a platform over a well comprising:

placing a winch unit on the main deck of the platform, the winch unit comprising at least two winches, the winches having cable thereon and being supported by a pivoted beam, the beam being supported at a spaced apart distance above a base frame by a load cell so as to indicate the lift force exerted by each winch;

placing movable beams between the skid beams of the platform;

placing a movable deck above the winch unit, the movable deck being supported by the movable beams and adapted to support slips for supporting the tubulars to be moved;

attaching to the cable of the winch an elevator, the elevator being below the main deck of the platform;

alternatively supporting the tubular string in the slips and the elevator and moving the elevator by cable on the winch; and connecting or disconnecting joints of the string of tubulars so as to move the string of tubulars through the aperture.

8. The method of claim 7 wherein the elevator is remotely controlled.

9. The method of claim 7 wherein the string of tubulars is comprised of casing.

10. The method of claim 7 wherein the string of tubulars is comprised of drill pipe.

11. The method of claim 10 further comprising the step of rotating the drill pipe after it is lowered through the main deck.

* * * * *